US011798710B2

(12) United States Patent
Zheng et al.

(10) Patent No.: US 11,798,710 B2
(45) Date of Patent: Oct. 24, 2023

(54) CABLE HAVING A PAIR OF INNER CONDUCTORS AND AN INNER INSULATING LAYER EXTRUSION MOLDED AROUND THE PAIR OF INNER CONDUCTORS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yang-Bo Zheng, Kunshan (CN); Juan Zheng, Kunshan (CN); Lu-Yu Chang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/560,873

(22) Filed: Dec. 23, 2021

(65) Prior Publication Data

US 2022/0215986 A1 Jul. 7, 2022

(30) Foreign Application Priority Data

Jan. 4, 2021 (CN) ..... 202120004328.6

(51) Int. Cl.
*H01B 7/18* (2006.01)
*H01B 13/14* (2006.01)
(Continued)

(52) U.S. Cl.
CPC ..... *H01B 11/002* (2013.01); *H01B 7/18* (2013.01); *H01B 13/14* (2013.01); *H01B 1/02* (2013.01); *H01B 3/30* (2013.01)

(58) Field of Classification Search
CPC ..... H01B 11/002; H01B 7/18; H01B 13/14; H01B 1/02; H01B 3/30
(Continued)

(56) References Cited

U.S. PATENT DOCUMENTS 4,454,379 A 6/1984 Cleveland et al.
4,481,379 A 11/1984 Bolick, Jr. et al.
(Continued)

FOREIGN PATENT DOCUMENTS

CN 108376580 A 8/2018
JP 2016027547 * 2/2016

*Primary Examiner* — Timothy J Thompson
*Assistant Examiner* — Michael F McAllister
(74) *Attorney, Agent, or Firm* — Ming Chieh Chang

(57) ABSTRACT

A cable includes: a core wire; an insulating layer covering the core wire in an extrusion molding manner, a shielding layer covering the insulating layer, and a sheath covering the shielding layer, the core wire comprising a pair of inner conductors and the inner insulating layer of the pair of inner conductors are simultaneously covered by extrusion molding. Under the premise of ensuring impedance matching, the cable reduces the distance between the two conductors, so that the cable has lower insertion loss, and the overall size of the cable is also smaller, at the same time, the cable has a high-speed data transmission capability with a signal frequency greater than 40 GHz.

17 Claims, 6 Drawing Sheets

(51) Int. Cl.
*H01B 1/02* (2006.01)
*H01B 3/30* (2006.01)
*H01B 11/00* (2006.01)

(58) Field of Classification Search
USPC ..... 174/388
See application file for complete search history.

(56) References Cited

U.S. PATENT DOCUMENTS 4,599,483 A * 7/1986 Kuhn ..... H01R 13/65918 439/502
8,440,910 B2 * 5/2013 Nonen ..... H01B 11/203 174/115
8,981,216 B2 * 3/2015 Grant ..... H01B 11/06 174/113 R
9,324,479 B2 * 4/2016 Sugiyama ..... H01B 11/002
10,204,717 B2 * 2/2019 Tsujino ..... H01B 7/0241
10,366,811 B2 7/2019 Kobayashi
10,950,369 B1 * 3/2021 Farkas ..... H01B 11/1834
2003/0150633 A1 * 8/2003 Hirakawa ..... H01B 11/002 174/36
2004/0026101 A1 * 2/2004 Ochi ..... H01B 11/1091 174/36
2006/0054334 A1 * 3/2006 Vaupotic ..... H01B 11/1008 174/106 R
2012/0145429 A1 * 6/2012 Nordin ..... H01B 11/203 174/34
2013/0087361 A1 * 4/2013 Kaga ..... H01B 3/441 174/110 SR
2014/0182881 A1 * 7/2014 Huang ..... H01B 11/1091 174/103
2016/0036112 A1 * 2/2016 Sugiyama ..... H01P 3/02 29/600
2016/0302334 A1 10/2016 Wang et al.
2017/0301431 A1 * 10/2017 Li ..... H05K 9/0098
2018/0047479 A1 * 2/2018 Hansen ..... H05K 9/0098
2018/0075948 A1 * 3/2018 Kobayashi ..... H01B 11/20
2018/0102204 A1 * 4/2018 Li ..... H01B 7/17
2018/0268965 A1 * 9/2018 Dettmer ..... H01B 11/203
2018/0301247 A1 * 10/2018 Kobayashi ..... H01B 7/0225
2021/0098157 A1 4/2021 Cai et al.
2021/0098158 A1 4/2021 Zheng et al.

* cited by examiner

CABLE HAVING A PAIR OF INNER CONDUCTORS AND AN INNER INSULATING LAYER EXTRUSION MOLDED AROUND THE PAIR OF INNER CONDUCTORS

BACKGROUND OF THE INVENTION

1. Field of the Invention

The present invention relates generally to a cable, and more particularly to a high-speed signal cable used to transmit high-frequency signals.

2. Description of Related Arts

A high-speed signal cable in the prior art usually includes a pair of signal core wires, a metal shielding layer covering the core wires, an outer insulating layer covering the metal shielding layer, and a pair of signal core wires. Both include an inner insulating layer and an inner conductor covered in the inner insulating layer. The inner conductor and inner insulating layer of each signal core wire are respectively integrally molded, and then the two signal wires are wrapped in the metal shielding layer. The position between the two independently formed signal core wires is relatively unstable, therefore, the electrical characteristics may be unstable.

China Patent No. CN108376580, published on Aug. 7, 2018, discloses a cable that comprises a pair of signal core wires and an extruded insulating layer that is simultaneously covered with a pair of core wires. The pair of core wires are respectively formed by extrusion molding, the process is complicated, and the distance between the two inner conductors is large, the insertion loss of the cable is large, and the overall size of the wire is large.

Therefore, it is necessary to provide a new type of cable with stable, reliable signal transmission and simple manufacture, which enables the cable to have lower insertion loss under the premise of ensuring the overall impedance matching.

SUMMARY OF THE INVENTION

A main object of the present invention is to provide a cable which reduces the distance between a pair of inner conductors as much as possible on the premise of ensuring impedance matching so that the cable has lower insertion loss.

To achieve the above-mentioned object, a cable comprises: a core wire having a pair of inner conductors and an inner insulating layer extrusion molded around the pair of inner conductors; an insulating layer extrusion molded around the core wire; a shielding layer covering the insulating layer; and a sheath covering the shielding layer.

Compared to prior art, the present invention has the following beneficial effects: through the double extrusion molding of the inner insulating layer and the insulating layer, the distance between a pair of inner conductors is reduced, so that the cable has lower insertion loss, and the overall size of the cable is also smaller, and at the same time, the cable of the present invention has a high-speed data transmission capability with a signal frequency greater than 40 GHz.

DETAILED DESCRIPTION OF THE PREFERRED EMBODIMENT

Figure 1:
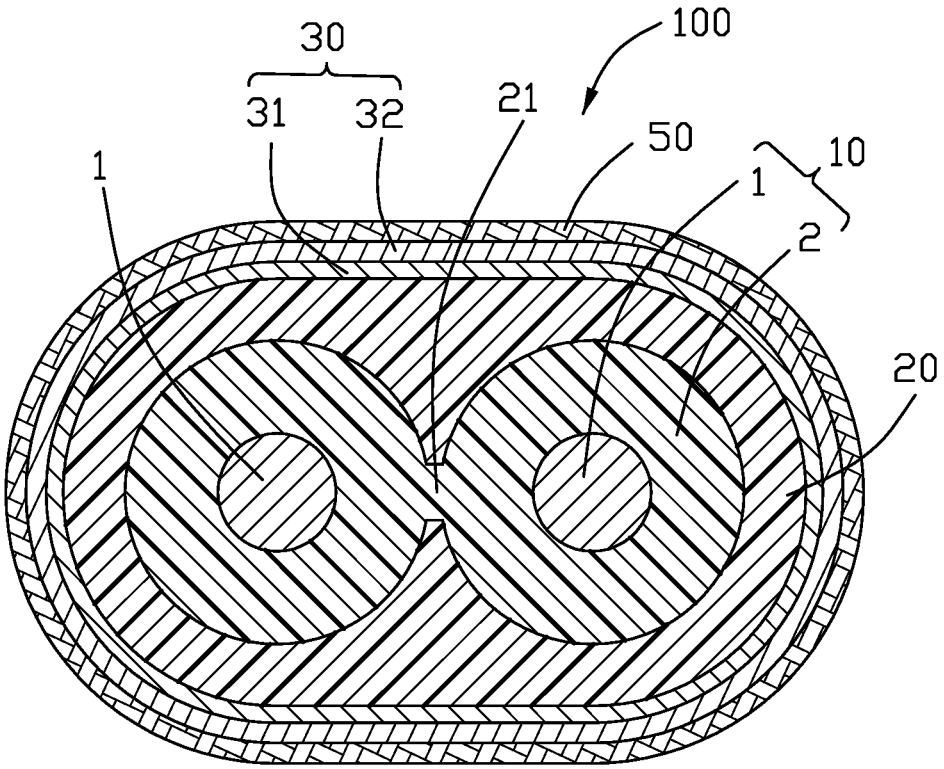
FIG. 1 is a cross-sectional view of a first embodiment of a cable of the present invention.

FIG. 1 shows the first embodiment of the cable 100 of the present invention. The cable 100 includes a core wire 10, an insulating layer 20 covering the core wire 10 by extrusion molding, a shielding layer 30 covering the insulating layer 20, and a sheath 50 covering the shielding layer 30.

In this embodiment, the core wire 10 includes a pair of inner conductors 1 and an inner insulating layer 2 simultaneously covering the pair of inner conductors 1 by extrusion molding. The inner conductor 1 is selected from the group including a copper inner conductor, a silver-plated copper inner conductor, and a tin-plated copper inner conductor. The inner insulating layer 2 is selected from the group including solid PP (polypropylene), solid PE (polyethylene), solid Teflon (polytetrafluoroethylene), foamed PP, foamed PE and foamed Teflon. The insulating layer 20 is selected from the group including solid PP, solid PE, solid Teflon, foamed PP, foamed PE, and foamed Teflon. The cross-sectional profile of the inner insulating layer 2 is glasses-shaped, and the cross-sectional profile of the insulating layer 20 is stadium-shaped. The inner insulating layer 2 is provided with a connecting portion 21, and the longitudinal dimension of the connecting portion 21 is smaller than the thickness of the inner insulating layer 2 outside the inner conductor 1. There is no air gap between the inner insulating layer 2 and the insulating layer 20.

The shielding layer 30 includes a first shielding layer 31 and a second shielding layer 32.The first shielding layer 31 is selected from the group including aluminum foil, copper foil, pure copper tape and silver-plated copper foil. The second shielding layer 32 is selected from the group including bare copper wire, tin-plated copper, silver-plated copper, aluminum foil, copper foil, pure copper tape, and silver-plated copper foil. The first shielding layer 31 may cover the insulating layer 20 in a spiral winding manner or a longitudinal coating manner, the second shielding layer 32 may cover the first shielding layer 31 in a spiral winding manner or a longitudinal coating manner. The sheath 50 is selected from the group including PE, PP, Teflon or PET (polyethylene terephthalate) wrapping tape. The PET wrapping tape can be arranged in one layer or multiple layers. The cable is not provided with a ground wire, but uses the shielding layer as the function of the ground wire.

Figure 2:
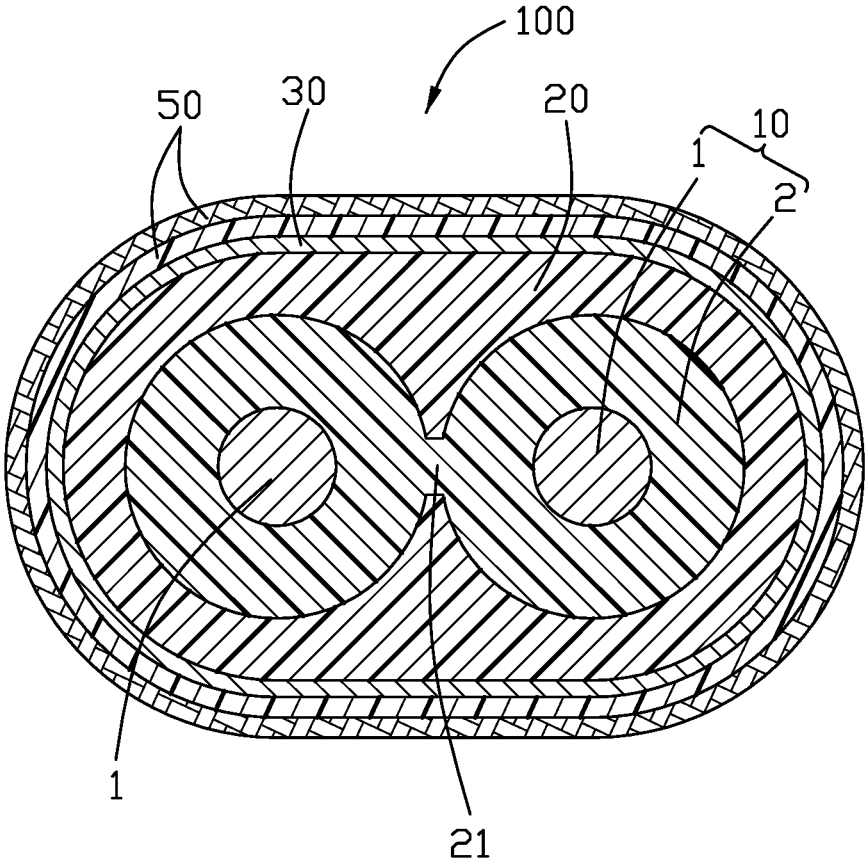
FIG. 2 is a cross-sectional view of a second embodiment of the cable of the present invention.

FIG. 2 shows the second embodiment of the cable 100 of the present invention. Compared with the first embodiment, in this embodiment, the shielding layer 30 is only provided as one layer, the shielding layer 30 is selected from the group including aluminum foil, copper foil, pure copper tape and silver-plated copper foil. The shielding layer 30 may cover the insulating layer 20 in a spiral winding manner or a longitudinal coating manner. The sheath 50 is a two-layer PET wrapping tape, of course, it can also be set as a one-layer PET wrapping tape.

Figure 3:
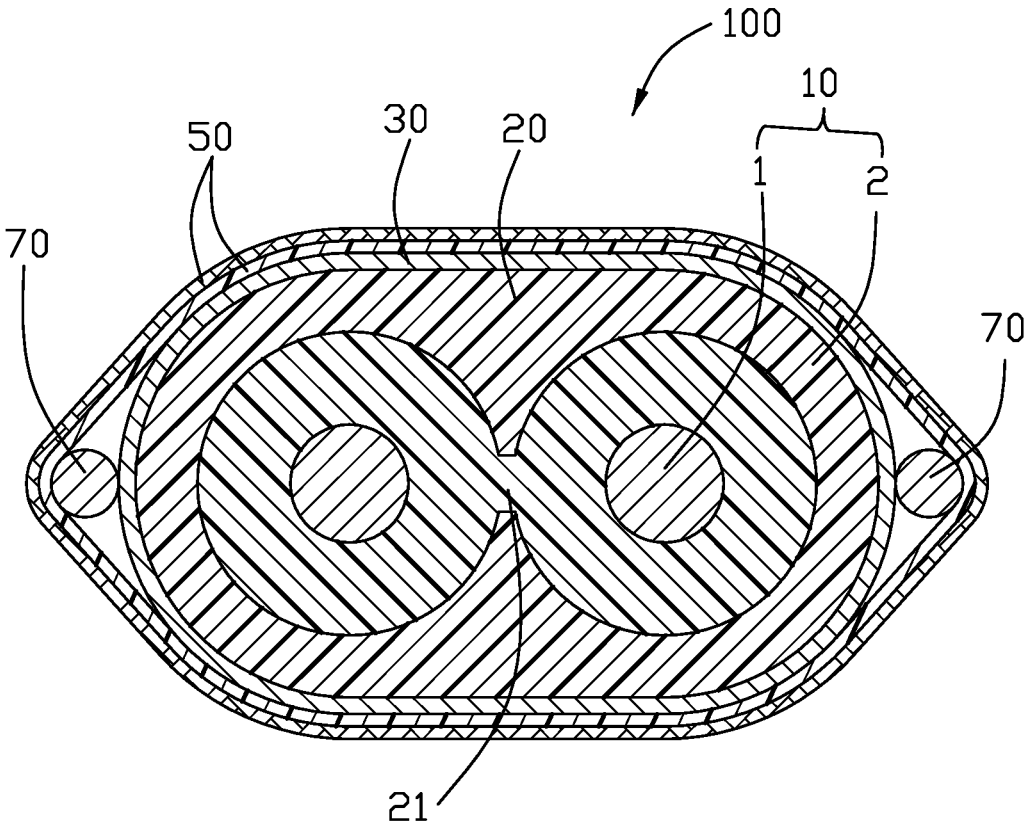
FIG. 3 is a cross-sectional view of a third embodiment of the cable of the present invention.

Referring to FIG. 3, which is the third embodiment of the cable 100 of the present invention. Compared with the second embodiment, in this embodiment, a pair of ground wires 70 are added. The pair of ground wires 70 are respectively located on both sides of the core wire, and the ground wire 70 is tightly sandwiched between the shielding layer 30 and the sheath 50. According to actual requirements, only one ground wire 70 may be added, and the ground wire 70 is located on one of the two sides of the core wire 10.

Figure 4:
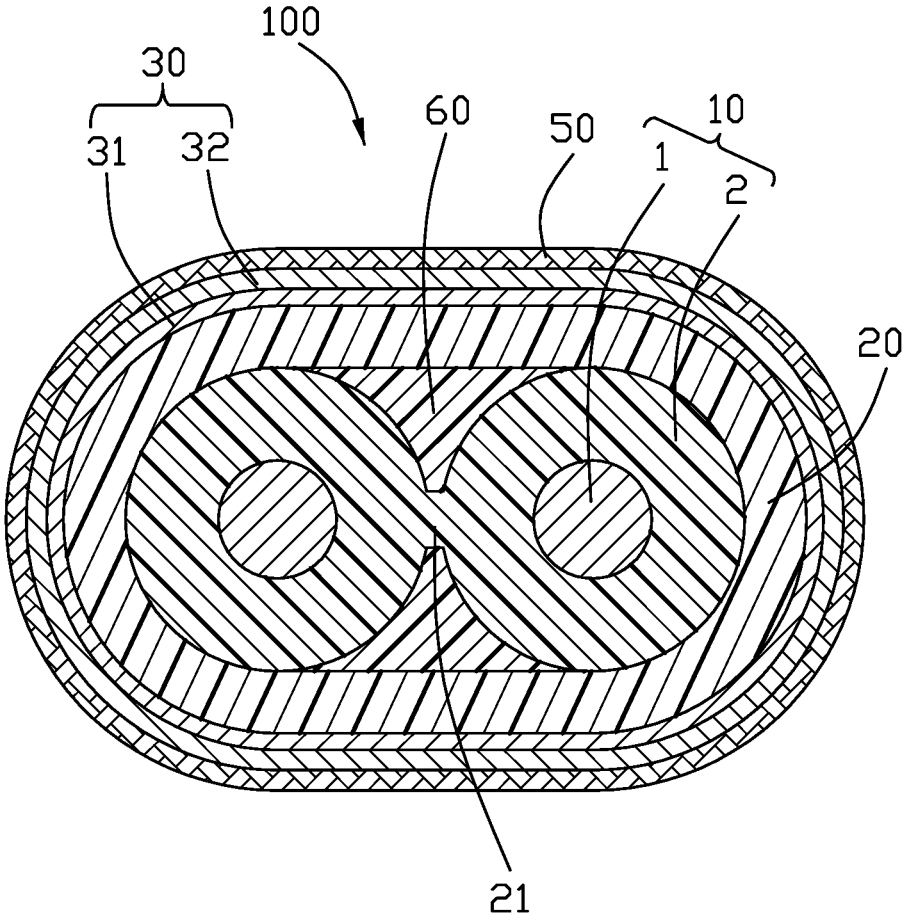
FIG. 4 is a cross-sectional view of a fourth embodiment of the cable of the present invention.

FIG. 4 shows the fourth embodiment of the cable 100 of the present invention. Compared with the first embodiment, in this embodiment, the upper and lower sides between the inner insulating layer 2 and the insulating layer 20 include air gaps 60.

Figure 5:
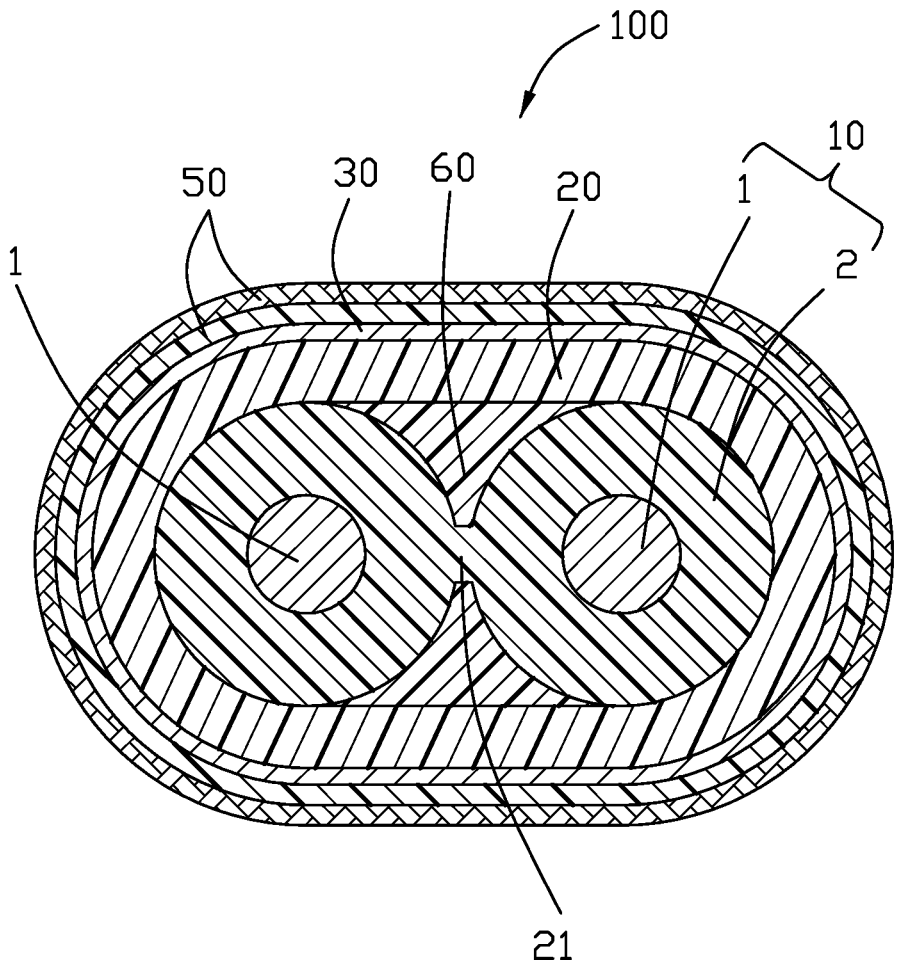
FIG. 5 is a cross-sectional view of a fifth embodiment of the cable of the present invention.

FIG. 5 shows the fifth embodiment of the cable 100 of the present invention. Compared with the second embodiment, in this embodiment, the upper and lower sides between the inner insulating layer 2 and the insulating layer 20 include air gaps 60.

Figure 6:
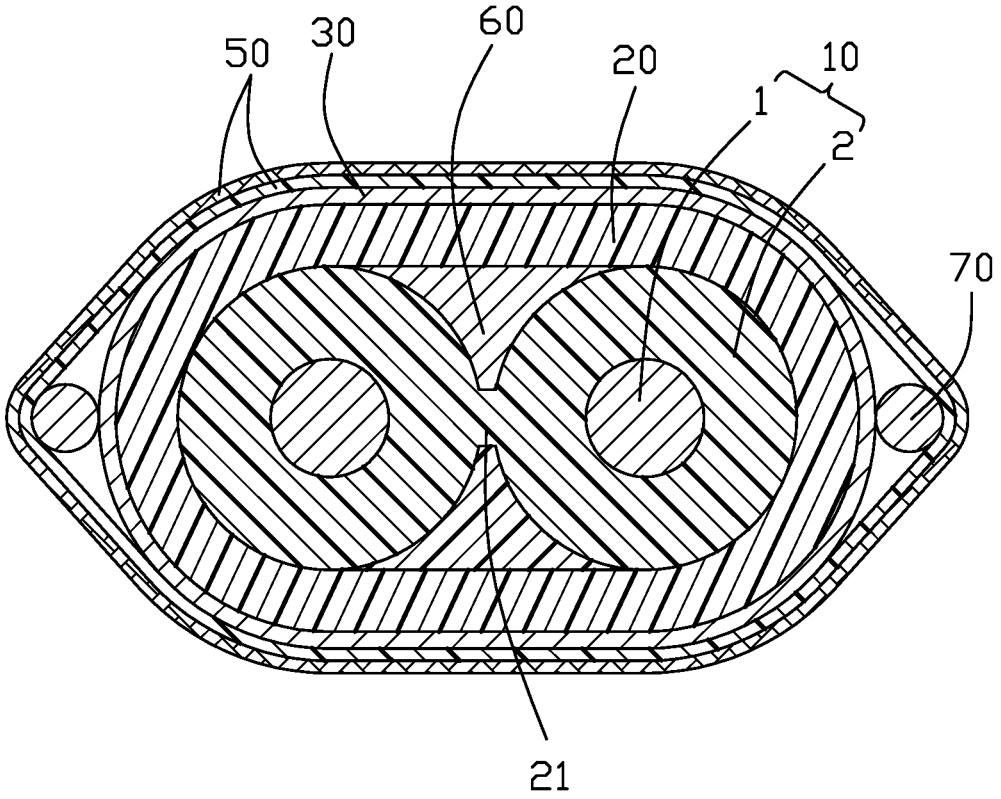
FIG. 6 is a cross-sectional view of a sixth embodiment of the cable of the present invention.

FIG. 6 shows the sixth embodiment of the cable 100 of the present invention. Compared with the third embodiment, in this embodiment, the upper and lower sides between the inner insulating layer 2 and the insulating layer 20 include air gaps 60.

The dielectric constant of air is smaller than that of insulating materials, and the attenuation during signal transmission is smaller, which makes the electrical performance of the cable better.

For the cable of the present invention, the inner insulating layer 2 simultaneously covers a pair of inner conductors 1 in an extrusion molding manner, and after forming a core wire, the insulating layer 20 is then coated to the core wire 10 in an extrusion molding manner. Through two extrusion molding methods, while ensuring the overall impedance matching, only the thickness of the inner insulating layer 2 is isolated between the two inner conductors 1, and the distance between the two inner conductors 1 is reduced, so that the cable 100 has lower insertion loss, and the overall outer diameter of the cable is also smaller. The cable of the present invention has a high-speed data transmission capability with a signal frequency greater than 40 GHz. It provides more options for the improvement of cable high-frequency characteristics.

The above describes only some of the embodiments of the present invention, but not all of the embodiments. Any equivalent changes to the technical solutions of the present invention by those skilled in the art by reading the description of the present invention are covered by the claims of the present invention.

What is claimed is:

1. A cable comprising:

a core wire having a pair of inner conductors and an inner insulating layer extrusion molded around the pair of inner conductors;

an insulating layer extrusion molded around the core wire;

a shielding layer covering the insulating layer; and a sheath covering the shielding layer; wherein the cross-sectional profile of the inner insulating layer is glasses-shaped, the cross-sectional profile of the insulating layer is stadium-shaped, the inner insulating layer is provided with a connecting portion, and the size of the connecting portion is smaller than the thickness of the inner insulating layer outside the inner conductor.

2. The cable as claimed in claim 1, wherein the inner conductor is selected from the group consisting of a copper inner conductor, a silver-plated copper inner conductor, and a tin-plated copper inner conductor.

3. The cable as claimed in claim 1, wherein the inner insulating layer and the insulating layer are selected from the group consisting of solid PP, solid PE, solid Teflon, foamed PP, foamed PE, and foamed Teflon.

4. The cable as claimed in claim 1, wherein the sheath is selected from the group consisting of PE, PP, Teflon, and PET wrapping tape.

5. The cable as claimed in claim 1, wherein there is no air gap between the inner insulating layer and the insulating layer.

6. The cable as claimed in claim 1, wherein an air gap is included between the inner insulating layer and the insulating layer.

7. The cable as claimed in claim 1, wherein the shielding layer comprises a first shielding layer and a second shielding layer, the first shielding layer is selected from the group consisting of aluminum foil, copper foil, pure copper tape, and silver-plated copper foil, the second shielding layer is selected from the group consisting of bare copper wire, tin-plated copper, silver-plated copper, aluminum foil, copper foil, pure copper tape, and silver-plated copper foil, and the cable is not provided with a ground wire.

8. The cable as claimed in claim 1, wherein the shielding layer is a single layer selected from the group consisting of aluminum foil, copper foil, pure copper tape, and silver-plated copper foil.

9. The cable as claimed in claim 8, further comprising a ground wire located on one of the two sides of the core wire, and the ground wire is tightly clamped between the shielding layer and the sheath.

10. The cable as claimed in claim 8, further comprising a pair of ground wires respectively located on both sides of the core wire, and the ground wires are tightly clamped between the shielding layer and the sheath.

11. A cable comprising:

a core wire having a pair of inner conductors and an inner insulating layer extrusion molded around the pair of inner conductors;

an insulating layer extrusion molded around the core wire;

a shielding layer covering the insulating layer; and a sheath covering the shielding layer; wherein the shielding layer comprises a first shielding layer and a second shielding layer, the first shielding layer is selected from the group consisting of aluminum foil, copper foil, pure copper tape, and silver-plated copper foil, the second shielding layer is selected from the group consisting of bare copper wire, tin-plated copper, silver-plated copper, aluminum foil, copper foil, pure copper tape, and silver-plated copper foil, and the cable is not provided with a ground wire.

12. The cable as claimed in claim 11, wherein the inner conductor is selected from the group consisting of a copper inner conductor, a silver-plated copper inner conductor, and a tin-plated copper inner conductor.

13. The cable as claimed in claim 11, wherein the inner insulating layer and the insulating layer are selected from the group consisting of solid PP, solid PE, solid Teflon, foamed PP, foamed PE, and foamed Teflon.

14. The cable as claimed in claim 11, wherein the sheath is selected from the group consisting of PE, PP, Teflon, and PET wrapping tape.

15. The cable as claimed in claim 11, wherein there is no air gap between the inner insulating layer and the insulating layer.

16. The cable as claimed in claim 11, wherein an air gap is included between the inner insulating layer and the insulating layer.

17. The cable as claimed in claim 11, wherein the shielding layer is a single layer selected from the group consisting of aluminum foil, copper foil, pure copper tape, and silver-plated copper foil.

* * * * *